United States Patent [19]

Hashimoto et al.

[11] 3,988,515

[45] Oct. 26, 1976

[54] CASE-HARDENING METHOD FOR CARBON STEEL

[75] Inventors: Hiroshi Hashimoto, Chiba; Kiyomitsu Suga, Kawaguchi; Toshio Shimizu, Tokyo, all of Japan

[73] Assignee: Kabushiki Kaisha Seikosha, Japan

[22] Filed: Feb. 11, 1975

[21] Appl. No.: 548,971

[30] Foreign Application Priority Data

Feb. 13, 1974 Japan ..... 49-17284

[52] U.S. Cl. ..... 427/249; 427/253; 427/399; 428/457

[51] Int. Cl.[2] ..... C23C 9/02

[58] Field of Search ..... 427/249, 228, 399, 253, 427/252; 148/6

[56] References Cited

UNITED STATES PATENTS

| | | | |
|---|---|---|---|
| 2,685,545 | 8/1954 | Sindeband | 427/259 X |
| 2,962,399 | 11/1960 | Ruppert et al. | 427/249 X |
| 3,579,373 | 5/1971 | Pingel | 427/249 |

*Primary Examiner*—Ralph S. Kendall
*Attorney, Agent, or Firm*—Robert E. Burns; Emmanuel J. Lobato; Bruce L. Adams

[57] ABSTRACT

A case-hardening method for forming a hardened layer on the surface of carbon steel of high toughness and hardness is provided which comprises forming a powdered mixture of titanium in an amount of 5 to 30% by weight of said mixture, chromium in an amount such that the weight ratio of chromium to titanium is within the range of 2 to 10, alumina and a catalyst, embedding carbon steel in said powder mixture, and then subjecting said mixture to a heat treatment to form a hardened layer mainly composed of titanium carbide. The method may also be carried out by coating the surface of carbon steel with alumina, preparing a powder mixture containing titanium in an amount of 5 to 30% by weight of said mixture chromium in an amount such that the weight ratio of chromium to titanium is within the range of 2 to 10, alumina and a catalyst, then embedding said alumina-coated carbon steel in said powder mixture, and then subjecting said mixture to a heat treatment to form a hardened layer mainly composed of titanium carbide.

4 Claims, 9 Drawing Figures

CASE-HARDENING METHOD FOR CARBON STEEL

This invention relates to metallic cementation for infiltrating and diffusing a metal element in the surface of carbon steel, and more particularly to a case-hardening method for forming a hardened layer having high toughness and hardness and mainly composed of titanium carbide according to a solid powder method.

Heretofore, titanium, chromium, niobium, vanadium, boron or like metal element has been used for case-hardening of steel materials, and such metal element has been treated by a gas method, liquid method or solid method. Let us here cite an instance of such known methods using the titanium carbide coating techniques. According to this method which is generally referred to as the vapor phase TiC plating method, a halide of titanium and hydrocarbon gas are fed into the reactor as a carrier and a substitition and reduction reaction is carried out therein at high temperature of approximately 1,000° to 1,100° C to precipitate titanium carbide TiC in the surface of the worked material. The TiC layer obtained from this method has extremely high hardness on the order of 3,000 to 4,000 in micro-Vickers hardness (HV), and it is used as an excellent anti-wear surface material, for instance, on the molds made of dies steel or such. It ensures a life of the article several times longer as compared with articles merely made of ordinary hardened steel. This hardening method, however, requires gas-doping equipment and a reactor, and also a good deal of care is necessary for gas control as the qualities of the processed layer, such as thickness, hardness and surface roughness of the coating layer, are directly affected by the mode of composition control of the feed gas containing hydrogen $H_2$, propane $C_3H_8$, titanium tetrachloride $TiCl_4$ and such. Further, as corrosive gas is used in the process, it is necessary to provide in the reactor a chamber formed from a non-metal such as silicon oxide $SiO_2$, resulting in an elevated manufacturing cost of the apparatus. Also, the thickness of the hardened layer formed by this method may vary according to the difference in position at which the work is set in the reactor, and adjustment of such layer thickness is attended by great difficulties. Further, non-uniformity in thickness of the treated layer gives rise to a difference in the coefficient of thermal expansion in each part of the work, which would cause undesirable deformation or impair the high-impact properties.

On the other hand, according to the chromizing method which has also been commonly used industrially, metallic chromium or ferrochromium is used as a chromium source and this is mixed with calcined alumina used for inhibiting powder deposition and a halogenated salt used as the catalyst to form a powder mixture, and then the workpiece is embedded in this powder mixture and heated to a temperature within the range of 950° to 1,100° C in an inert gas atmosphere, with the produced chromium halide being subjected to a substitution and reduction reaction to precipitate chromium in the surface of the workpiece. This method is advantageous over the aforementioned vapor-phase TiC plating method in that the process is easy and the apparatus used for the process is simple, but the hardness of the hardened layer obtained from this method is within the range of approximately 1,600 to 1,800 in micro-Vickers hardness (HV), and hence this method has a problem of providing satisfactorily high wear resistance.

The present invention concerns a method for forming a hardened surface layer which is mainly composed of TiC and which has very high hardness of approximately 2,000 to 3,500 in micro-Vickers hardness (HV) and excellent toughness, such method being simple and easy to carry out.

More specifically, according to the method of the present invention, metallic chromium and metallic titanium are used as the diffusing metal source and they are mixed with inert calcined alumina powder (which is used for the purpose of preventing fusion of the powder) and a catalyst to form a powder mixture, and then carbon steel is embedded in this powder mixture and heated in an atmosphere of an inert gas, such as hydrogen or argon to thereby form a high-toughness hardened layer mainly composed of titanium carbide TiC.

Among the conventional chromizing methods, there is known a process in which a small amount of titanium powder is added. In this case, however, titanium Ti having greater affinity for oxygen $O_2$ than chromium Cr is added in a very small amount for the purpose of minimizing reaction between chromium and oxygen, so as to prevent reduction or recovery of chromium Cr due to generation of chromium oxide by reaction with oxygen $O_2$ or vapor $H_2O$, which exists in a very small proportion in the atmosphere, during heating at high temperature. In the case of the aforementioned vapor-phase TiC plating, it has also attempted to add chromium, but such addition of chromium is merely intended to produce chromium carbide having a greater coefficient of thermal expansion than TiC in the middle region between the ground and the TiC layer, so as to lessen strain or distortion directly exerted on the TiC layer, thereby improving adhesion.

The method of the present invention is quite distinguished from such prior art proposals in that simultaneous precipitation of titanium and chromium is accomplished positively.

According to the method of the present invention, the titanium content in the powder mixture is defined within the range of 5 to 30 weight %. If the titanium content is less than 5 %, there is formed a hardened layer made solely from the carbides of chromium as shown in the X-ray diffraction pattern of FIG. 1, and no desired high hardness is obtained. On the other hand, if the titanium content exceeds 6 %, titanium is separated and diffused too much unless the coexisting chromium content is over 60 %. Therefore, generation of pure TiC is retarded and, consequently, there is formed a low-hardness (1,000 to 1,800 Hv) layer where TiC and solid solution (Fe-Ti) coexist, as shown in the X-ray diffraction pattern of FIG. 4. The above-defined range of titanium content is based on such reasoning. The recommended range of chromium content is determined by the titanium content, and usually, the weight ratio of chromium to titanium (Cr/Ti) is within the range of 2 to 10. The reason for adding chromium is to control the yield of the solid solution Fe-Ti, and the optimal amount of chromium for such purpose is approximately 2 to 10 times the amount of titanium.

The present invention also involves, as another embodiment thereof, a method in which carbon steel is first coated with alumina $Al_2O_3$ and then subjected to the completely same treatment as said above to form a high-toughness hardened layer mainly composed of titanium carbide TiC.

In the conventional carburizing methods, the primary purpose of coating the steel material with alumina was to prevent fusion of metal to the work surface and to obtain a smooth and beautiful surface when, for instance, infiltrating a low-melting-point metal, such as aluminium, in the work surface. In the method of the present invention, however, such alumina coating is practiced for a different reason. That is, in case carbon steel is not coated with alumina and directly contacted with the powder mixture, there may take place enfolding of metallic chromium in the formed hardened layer, and since the affinity of carbon is lower than titanium, such metallic chromium could be left as it is in the layer. If such should occur, and if the particle size of metallic chromium used is large, the treated surface is roughened and there are also formed "soft spots" to excessively impair the quality of the hardened layer. Such a situation is diagrammed in the X-ray diffraction pattern of FIG. 5. Coating of alumina (inert powder) on carbon steel in the present invention is intended to avoid such trouble. This pretreatment can not only prevent metallic chromium from being left as soft spots in the layer as said above but also allows easy reduction of a part of finely precipitated chromium into chromium carbide, thus providing high toughness to the hardened layer while maintaining high hardness.

The method of the present invention is now described in further detail by way of some preferred embodiments thereof.

EXAMPLE 1

There have been prepared the powder mixtures A to O having the compositions such as shown in Table 1 by using commercially available 200-mesh metallic chromium powder, 400-mesh metallic titanium, 400-mesh calcined alumina and ammonium chloride $NH_4Cl$ as catalyst. In Table 1, the amount of ammonium chloride $NH_4Cl$ used as catalyst is given by weight ratio per 100 parts of powder mixture consisting of chromium Cr, titanium Ti and alumina $Al_2O_3$.

Strip-shaped pieces of 1.0 mm-thick tool steel SK-4 were immersed in a 2 % methyl cellulose aqueous solution suspended with 400-mesh calcined alumina to coat said pieces with alumina, and then the alumina-coated pieces were air-dried to thereby prepare the pretreated specimens.

These alumina-coated specimens and the specimens which have not undergone said pretreatment were embedded in each of the powder mixtures specified in Table 1, and then subjected to a heat treatment at 1,050° C for three hours in an argon gas atmosphere. The surfaces of the thus treated specimens were examined by X-ray diffraction method after performing light buffing on said surfaces. The results are shown by the X-ray diffraction patterns of FIGS. 1 to 5.

Table 1

| Powder mixture | Cr | Ti | Cr/Ti | $Al_2O_3$ | $NH_4Cl$ |
|---|---|---|---|---|---|
| A | 60 | — | | 40 | 10 |
| B | 54 | 5 | 11 | 41 | 10 |
| C | 56 | 8 | 7 | 46 | 10 |
| D | 50 | 8 | 6.3 | 42 | 10 |
| E | 46 | 11 | 4.2 | 43 | 10 |
| F | 42 | 14 | 3.0 | 44 | 10 |
| G | 39 | 16 | 2.4 | 45 | 10 |
| H | 36 | 18 | 2.0 | 46 | 10 |
| I | 30 | 23 | 1.3 | 47 | 10 |
| J | 19 | 30 | 0.6 | 51 | 10 |
| K | — | 44 | 0 | 56 | 10 |
| L | — | 16 | 0 | 84 | 10 |

Table 1-continued

| Powder mixture | Cr | Ti | Cr/Ti | $Al_2O_3$ | $NH_4Cl$ |
|---|---|---|---|---|---|
| M | — | 27 | 0 | 73 | 10 |
| N | 63 | 7 | 9 | 30 | 10 |
| O | 80 | 8 | 10 | 12 | 10 |

FIG. 1 shows the X-ray diffraction pattern of the specimens treated by powder mixture B. Due to small amount of titanium Ti added and high chromium to titanium (Cr/Ti) ratio (11), chromium carbides alone are detected and no precipitation of titanium is admitted.

FIG. 2 shows the result of observation on the specimens treated by powder mixture D. The diffraction pattern reveals coexistence of $\beta$-phase chromium carbide ($Cr_{23}C_6$) with small carbon content and TiC.

FIG. 3 shows the result obtained from the specimens treated by powder mixture E. In this case, no $Cr_{23}C_6$ is seen and peaks of TiC are prominent.

FIG. 4 represents the result from the specimens treated by powder mixture I where the chromium/-titanium ratio is 1.3. There is observed existence of Fe-Ti solid solution besides the peaks of TiC.

FIG. 5 shows the result obtained from the specimens which has not been subjected to the pretreatment and which were treated by powder mixture E. The existence of the chromium element besides the peaks of TiC is observed.

FIG. 6 is a graph showing the results of measurement of surface hardness of the hardened layers obtained from said respective treatments. In this graph, the abscissa is measured as chromium/titanium weight ratio and the ordinate as micro-Vickers hardness. As easily understood from the graph, high hardness of over 2,000 Hv is obtained when the Cr/Ti ratio is substantially within the range of 2 to 10. Each dot on the graph represents the specimen treated by a powder mixture indicated by a letter.

Dots K, L and M in the graph represent the specimens treated by the powder mixtures K, L and M, respectively. Since the Ti content is small and no chromium coexists in these powder mixtures, no perfect TiC is produced and hence hardness of the obtained layer is low.

EXAMPLE 2

There have been prepared powder mixtures P – S having the compositions such as shown in Table 2 by using commercially available 200-mesh metallic chromium, 400-mesh metallic titanium, 400-mesh calcined alumina and ammonium chloride $NH_4Cl$ as catalyst. In Table 2, the amount of ammonium chloride $NH_4Cl$ added as catalyst is given by weight ratio per 100 parts of mixture of chromium Cr, titanium Ti and alumina $Al_2O_3$.

1 mm-thick plates of tool steel SK-4 were immersed in a 2 % methyl cellulose aqueous solution mixed with 400-mesh calcined alumina to effect coating of alumina $Al_2O_3$ and the thus alumina-coated plates were air-dried to prepare the pretreated specimens. These alumina-coated specimens were embedded in each of the powder mixtures specified in Table 2 and then subjected to a heat treatment at 1,010° C for 2 hours in an argon gas atmosphere. The surfaces of the thus treated specimens were lightly buffed and then their micro-Vickers hardness was measured. The results are given in the rightmost column of Table 2.

Table 2

| Powder mixture | Weight % Cr | Ti | Cr/Ti | $Al_2O_3$ | $NH_4Cl$ | Micro-Vickers hardness (Hv) |
|---|---|---|---|---|---|---|
| P | 30 | 30 | 1 | 40 | 10 | 1200 |
| Q | 50 | 30 | 1.7 | 20 | 10 | 1800 |
| R | 60 | 30 | 2 | 10 | 10 | 2850 |
| S | 40 | 20 | 2 | 40 | 10 | 2560 |

As noted from the figures in the rightmost column of this table, hardened layers of high hardness, such as 2850 Hv or 2560 Hv, are obtained even when the work is treated by a powder mixture where the Cr/Ti ratio is 2 (R and S).

EXAMPLE 3

There has been prepared a powder mixture T having the composition of $30Cr\text{-}10Ti\text{-}60Al_2O_3$ with $10NH_4Cl$ by using the same kind of chromium, titanium, calcined alumina and ammonium chloride as used in the preceding examples. Then, a high-carbon steel SKD plate which had not been subjected to the pretreatment of alumina coating and an alumina-coated tool steel SK-4 plate were embedded in said powder mixture T and heated at 1,050° C for 2 hours in an argon atmosphere. FIGS. 7 to 8 are microphotographs of the obtained hardened layers. FIG. 7 is a sectional microphotograph of the hardened layer in the SKD plate which had not undergone said pretreatment. The surface of the layer is not smooth. FIG. 8 is a planer microphotograph of the same layer. It is seen that metallic chromium exists sporadically in the form of white spots. FIG. 9 is a sectional microphotograph of the hardened layer in the SK-4 plate which had been subjected to the pretreatment of alumina coating. It is noted that the surface of the hardened layer is uniform and smooth.

Although high-carbon steel was used in the above example, it is also possible to produce a hardened layer with low-carbon steel by first practicing a carburizing treatment on said steel and then subjecting it to the same treatment as described above. Also, the catalyst used in the process is not confined to ammonium chloride; it is possible to use ammonium bromide, ammonium fluoride or other hydrazine hydrogen halides, such as for example $N_3H_4$, 2HCl, which produce only a small amount of active nitrogen by pyrolysis, and in the latter case, the best treated layer can be obtained. In either case, the heating temperature is preferably within the range of 900° to 1,100° C.

As described above in detail, it is possible with the method of the present invention to produce a high-hardness hardened layer mainly composed of titanium carbide with ease and at amazingly low cost by a solid powder method with no need of using any expensive equipment such as gas doping apparatus or reactor as necessitated in the conventional gas method. Also, owing to admixture of chromium carbide in the hardened layer which is mainly composed of titanium carbide, the obtained layer is provided with high toughness without suffering any decline of its hardness. Further, each article treated is given a uniform hardened layer regardless of location at which the article is set in the reactor, and hence no deformation takes place on the article after treatment. Moreover, the pretreatment of alumina coating on the article to be treated ensures formation of a hardened layer with smooth surface and high quality.

Figure 1:
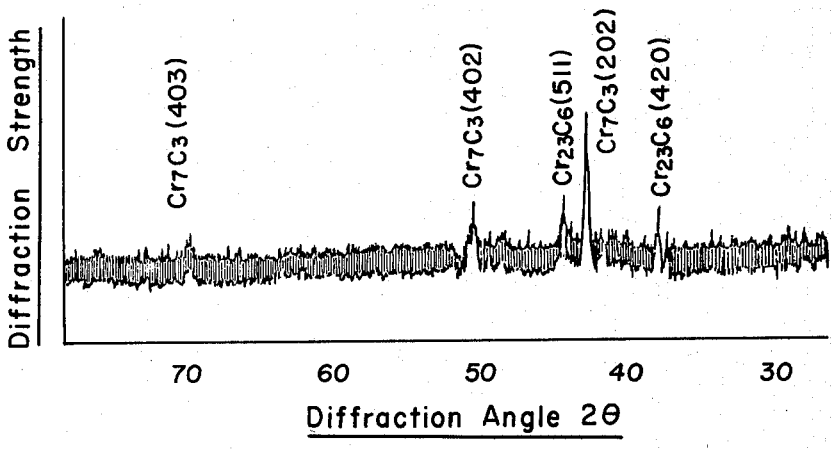
FIGS. 1 to 5 are X-ray diffraction patterns of the formed surface layers as measured by using a Cu target and an Ni filter and by applying a voltage of 35 KV and a current of 8 mA, and the abscissa of the graph is measured as diffraction angle 2 $\theta$ and the ordinate as diffraction strength.
Figure 2:
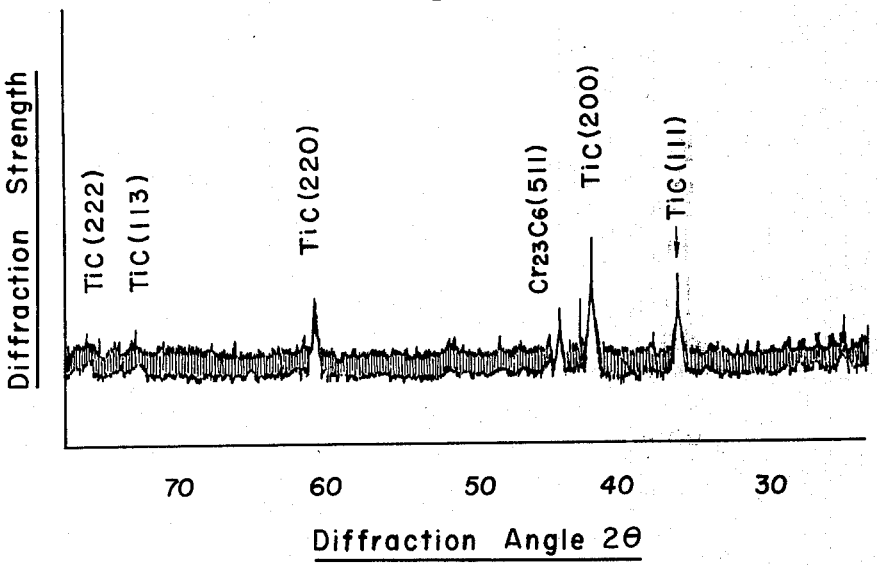
Figure 3:
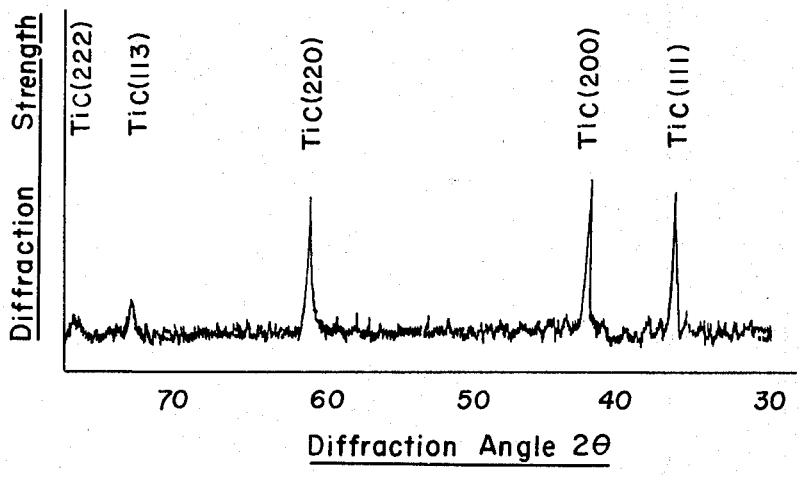
Figure 4:
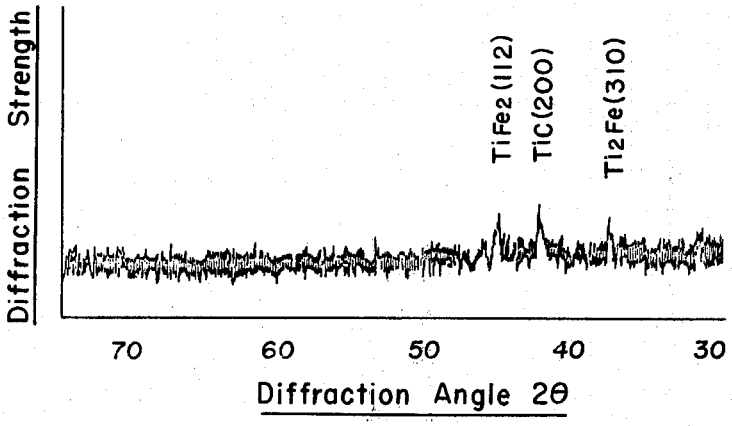
Figure 5:
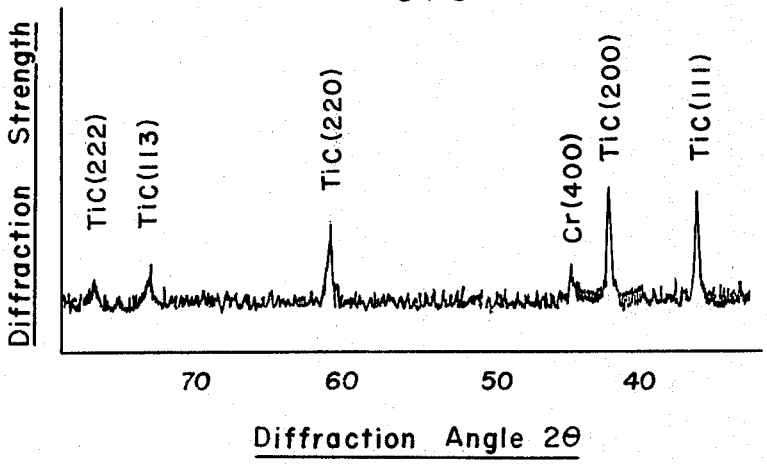
Figure 6:
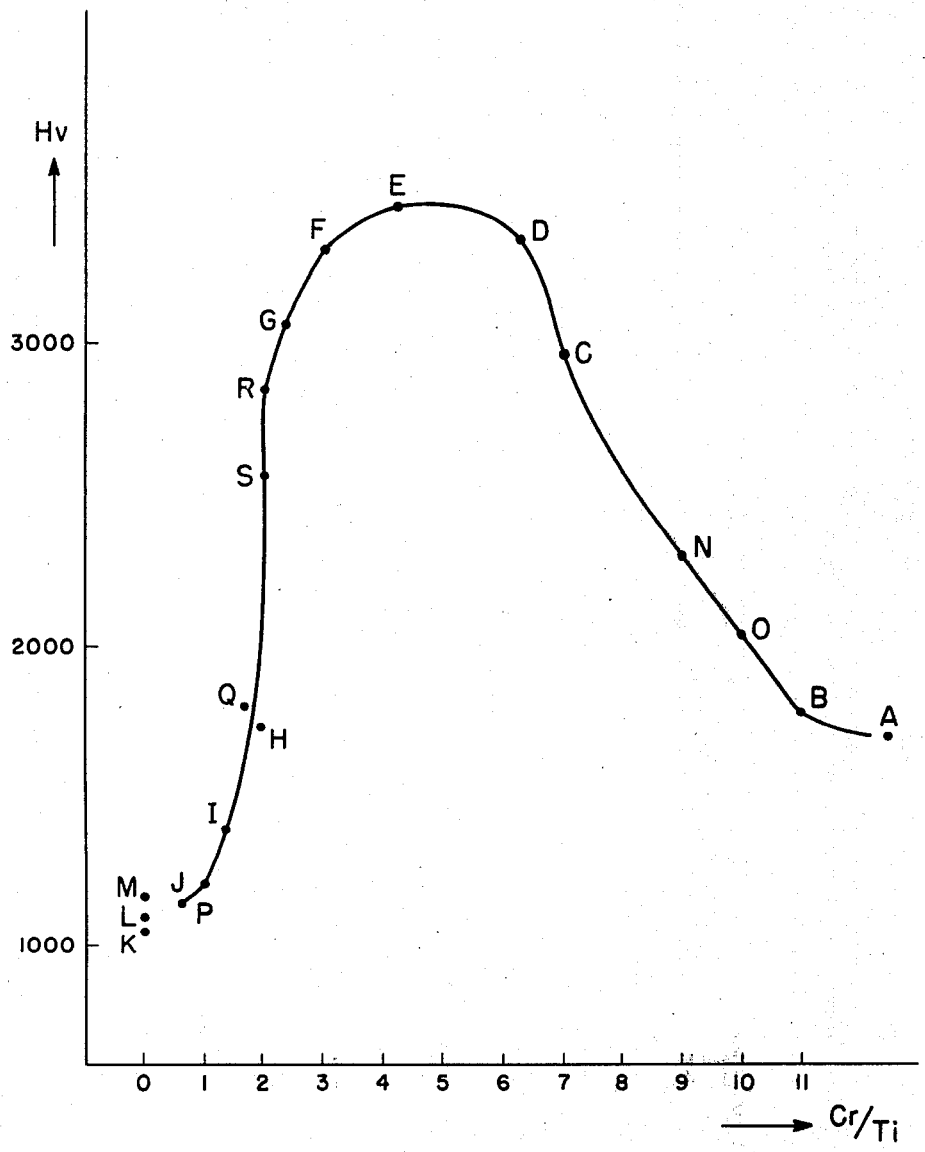
FIG. 6 is a graph showing micro-Vickers hardness of resultant surface layers, where the abscissa is measured as Cr/Ti weight ratio and the ordinate as Vickers hardness.
Figure 7:
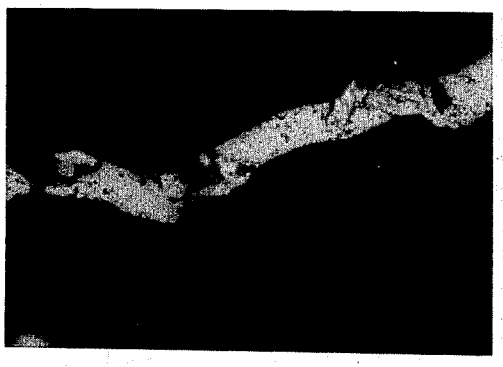
FIGS. 7 to 9 are microphotographs of the produced surface layers.
Figure 8:
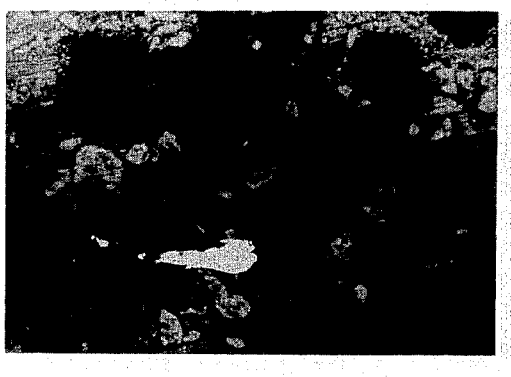
Figure 9:
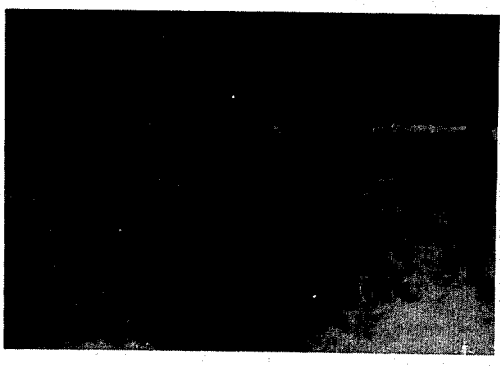

What is claimed is:

1. In metallic cementation of carbon steel according to the solid powder method, a case-hardening method for carbon steel comprising the steps of preparing a powder mixture containing titanium in an amount of 5 to 30 % by weight of said mixture, chromium in an amount such that the weight ratio of chromium to titanium is within the range of 2 to 10, alumina and a catalyst which is a halogen salt, embedding carbon steel in said powder mixture, and then subjecting said mixture to a heat treatment to form a hardened layer mainly composed of titanium carbide TiC.

2. In metallic cementation of carbon steel according to the solid powder method, a case-hardening method for carbon steel comprising the steps of coating the surface of carbon steel with alumina, preparing a powder mixture containing titanium in an amount of 5 to 30% by weight of said mixture, chromium in an amount such that the weight ratio of chromium to titanium is within the range of 2 to 10, alumina and a catalyst which is a halogen salt, then embedding said alumina-coated carbon steel in said powder mixture, and then subjecting said mixture to a heat treatment to form a hardened layer mainly composed of titanium carbide TiC.

3. A case-hardening method according to claim 1 in which said heat treatment is carried out at a temperature of about 900° to 1,100° C.

4. A case-hardening method according to claim 2 in which said heat treatment is carried out at a temperature of about 900° to 1,100° C.

* * * * *